United States Patent [19]

Summa

[11] Patent Number: 4,859,914

[45] Date of Patent: Aug. 22, 1989

[54] HIGH FREQUENCY ENERGY SAVING BALLAST

[76] Inventor: Frank A. Summa, 22 Starbuck St., Staten Island, N.Y. 10304

[21] Appl. No.: 166,744

[22] Filed: Mar. 2, 1988

Related U.S. Application Data

[63] Continuation of Ser. No. 758,779, Jul. 25, 1985, abandoned.

[51] Int. Cl.[4] ..... H05B 41/00

[52] U.S. Cl. ..... 315/354; 315/206; 315/DIG. 7

[58] Field of Search ..... 315/177, 206, 212, 220, 315/254, 266, 276, 286, 354, DIG. 4, DIG. 7

[56] References Cited

U.S. PATENT DOCUMENTS 4,394,603 7/1983 Widmayer ..... 315/DIG. 7

4,435,670 3/1984 Evans et al. ..... 315/177

*Primary Examiner*—Robert L. Griffin

*Assistant Examiner*—T. Salindong

*Attorney, Agent, or Firm*—Sherman and Shalloway

[57] ABSTRACT

A circuit is disclosed for energizing electrical devices such as fluorescent lamps and other gas discharge luminescent devices. The circuit provides energizing signals for gaseous discharge tubes at a voltage sufficient to initiate ionization of the gases therein. The signals are characterized by frequencies in the range of from about 60 hertz to 30 megahertz. After ignition the circuit automatically reduces the voltages and currents of the devices to a level sufficient to maintain gas ionization, and save energy. The circuit also reduces shock hazard. A preferred wave shaping in the energizing circuit is disclosed which creates purer square and sine waves for reducing radio frequency interference and electromagnetic interference, and a "soft-on" circuit is disclosed which greatly reduces the voltages applied to the devices thereby increasing the life of the devices. An automatic and a manual dimming section are also disclosed which dim the light output for the devices. The dimming sections, which are independent of each other, save additional energy.

8 Claims, 2 Drawing Sheets

HIGH FREQUENCY ENERGY SAVING BALLAST

This application is a continuation of application Ser. No. 758,779 filed July 25, 1985, now abandoned.

BACKGROUND OF THE INVENTION

This invention relates generally to circuits for providing high frequency energizing signals to electrical devices such as luminescent lamps and is an improvement on my U.S. Pat. No. 4,066,930 dated Jan. 3, 1978, incorporated herein by reference.

A standard measure of the efficiency of energy utilization in luminiscent sources is a parameter called "efficacy" which is the ratio of luminous flux output to the total power input. For example, the efficacy of present day fluorescent tubes is about 55 to 65 lumens per watt as compared to a figure of about 40 lumens per watt for typical incandescent lamps. Solely from the standpoint of energy utilization efficiency, therefore it is desirable to use fluorescent lamps for many lighting needs.

However, as relatively efficient as they are when compared with other light sources, present day fluorescent lamps fall far short of the efficiencies theoretically possible. Fluorescent lamps require a high voltage to initiate current flow across the lamp terminals and require a high current to initiate and to maintain ignition. This is due to the fact that there is an infinitely high impedance existing in the tube prior to ignition. Ignition occurs when the gases inside the tube are ionized permitting current to flow between the electrodes at opposite ends of the tube. Once a gaseous discharge tube has ignited, it exhibits a negative resistance characteristic and some form of current control device, such as a ballast, is typically utilized to limit the current to the tube.

Typically a fluorescent lamp ballast includes circuitry adapted to direct a high voltage (which may be as high as 1600 volts) to the gas tube electrodes. This high voltage is necessary in order to force electron emission from the electrodes and to thereby initiate ionization of the gases in the tubes. One or both of the electrodes generally comprises a filament which has the capacity of more readily emitting electrons when heated and subjected to high voltage and current.

One disadvantage with present day mercury, sodium vapor, and fluorescent lamp circuits is the loss of energy in the operation of the ballasts and in the heating of the filament electrodes. Another disadvantage is that the lifetime of the lamps is controlled principally by the mechanical integrity of the filaments. Once the filaments break and cease to emit electrons, a lamp no longer functions even though the light producing components of the lamp such as the gases in the tube and the phosphors on the tube walls remain functional. The present day ballasts continue to feed voltage and current into the system even though there is no live tube to effectively utilize it. This causes lamp flickering and overheating and can become extremely hazardous.

It is generally acknowledged that the energization of fluorescent tubes with high frequency signals is more effective and efficient than the standard ballast circuits. For one reason or another such as improper frequency circuit malfunctions in critical areas, excess radio frequency interference, or electromagnetic interference, however, these systems have not been commercially feasible. Apparently, in prior art circuits too much energy is lost in the switching and amplification of transistors and in the operation of the power transformer.

Another disadvantage of present circuits is the fact that bulb life is greatly reduced and the ends of the tubes tend to become blackened due to current distortions in the tubes caused by the introduction into the tubes of signals carrying too many harmonics.

SUMMARY OF THE INVENTION

The present invention may be characterized generally as a energizing circuit for the ignition of fluorescent lamps and other gas discharge luminiscent devices. The energizing circuit of the invention comprises an AC or DC voltage source coupled to an oscillator circuit. The oscillator circuit is adapted to generate energizing signals at a fixed frequency which is predetermined by the size and characteristics of the device being energized. The frequency may be in the range between 60 Hz to 30 MHz. The waveform of the energizing signals approximates a sine wave and the oscillator circuit comprises at least one transistor.

An embodiment of the energizing circuit of the present invention includes a ferromagnetic pot core power transformer or ferromagnetic power E transformer which is operable over a wide range of frequencies. The cores are interchangeable with a ferromagnetic U core. The power E core, which is ferromagnetic, includes a primary winding coupled between the DC power supply positive terminals and the collector of a transistor through a biasing diode. The secondary winding is connected to the fluorescent tube. A tertiary winding is connected to a parallel R-C circuit, and optional heater windings are connected to the fluorescent tubes.

The present embodiment also contains triacs at the input section which function as safety devices which open when a fluorescent tube is pulled out of the circuit or is no longer functional.

The present embodiment contains Darlington transistors which serve to shape the current waves to the power transistor and in the "soft-on" section of the circuit.

It is a feature of the present invention that the operating lifetimes of gaseous discharge lamps are greatly extended by the elimination of the filament electrodes, although the present invention is adaptable to and can be used on tubes containing filament electrodes.

It is also a feature of the present invention that the triac safety section, the wave-shaping Darlington transistors and the "soft-on" section of the circuit are unique in their functions and useful to the circuitry in promoting the longevity of the circuit and of the gaseous discharge tube.

Other and further objects, aspects and features of the present invention will become more apparent from the following detailed description of the preferred embodiments when read in conjunction with the appended drawing figures, and various advantages not referred to herein will occur to one skilled in the art upon employment of the invention in practice.

BRIEF DESCRIPTION OF THE DRAWINGS

The above and other objects, advantages and features of the invention will become more apparent when considered with the following specification and accompanying drawings wherein.

DESCRIPTION OF THE PREFERRED EMBODIMENT

Figure 1:
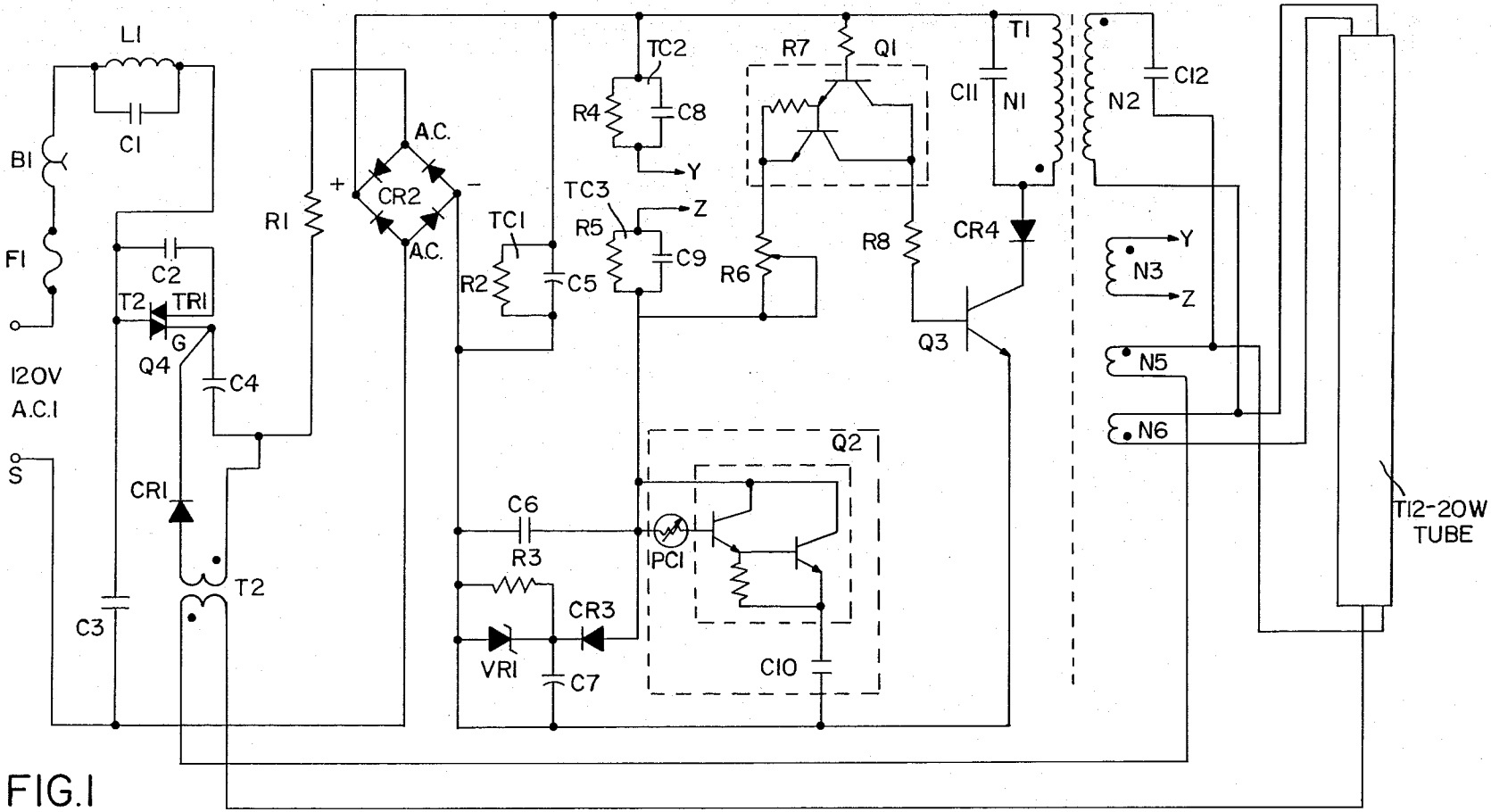
FIG. 1 is an electrical schematic diagram illustrating one embodiment of the electrical energizing circuit of the present invention.

One embodiment of the energizing circuit of the present invention is illustrated in FIG. 1. One side of the input voltage, from AC source 1, is connected to one side of safety fuse F1, the opposite side of safety fuse F1 is connected to one side of thermal switch B1, and the opposite side of thermal switch B1 is coupled to one side of choke coil L1 and capacitor C1. The opposite sides of capacitor C1 and choke coil L1 are connected to one side of capacitor C2, and the opposite side of C2 is coupled to trigger T1 of triac Q4. The opposite side of triac Q4(T2) is connected to one side of capacitor C3 and the opposite side of capacitor C3 is connected to the opposite side of the input voltage. The gate G of triac Q4 is coupled to one side of polarized capacitor C4 (positive) and one side of diode CR1 (negative). The positive side of diode CR1 is coupled to the end windings of transformer T2, and the start winding of isolation transformer T2 is coupled to one side of C4 (negative) and to one side of resistor R1. The opposite side of resistor R1 is connected to bridge rectifier CR2 (AC), and the opposite side of bridge rectifier CR2, (AC) is connected to capacitor C3. The opposite side of transformer T2 (primary start) is connected to the end winding N5 of transformer T1 and the opposite side of winding N5 is coupled to a of the fluorescent tube and to one side of capacitor C12.

The end winding of transformer T2 is connected to another lead (normally) to the fluorescent tube 30. The positive side of capacitor C12 is coupled to the start winding N2 of transformer T1 and the lower end of winding N2 is connected to the end winding N6 of transformer T1. Start winding N6 is connected to a lead (normally blue) of the fluorescent tube 30, and the end winding N6 is connected to a blue lead to the fluorescent tube.

The positive side of full wave bridge rectifier CR2 is commonly coupled to one side of parallel time constant circuit TC1 comprised of resistor R2, and capacitor C5, parallel time constant circuit TC2 comprised of resistor R4, and capacitor C8, to one side of biasing resistor R7 and to the upper end of primary winding N1 of transformer T1. Start winding N1 is also coupled to the positive end of biasing diode CR4, and the negative side of CR4 is coupled to the collector of transistor Q3. Resistor R7 reduces sensitivity and gain of transistor Q1, and if desired, a similar resistor could be included in the base circuit of transistor Q2 (to correspond to resistor R29 connected to the base of transistor Q22 of FIG. 2). Diode CR4 regulates the voltage to transistor Q3 and prevents overload. The positive side of CR4 is also coupled to one side of capacitor C11, and the opposite side of capacitor C11 is connected to the positive side of the DC input from bridge rectifier CR2. The base of transistor Q3, is connected to one side of biasing resistor R8 and the opposite side of resistor R8 is connected to the collectors of Darlington transistor pair Q1. The base of the Darlington transistor pair Q1 is connected to one side of biasing resistor R7 and the opposite side of resistor R7 is connected to the positive side of the DC input from bridge rectifier CR2. The emitters of the Darlington transistor Q1 are connected to one side of the manual dimmer potentiometer R6 and the opposite side of potentiometer R6 is connected to the parallel time constant circuit TC3 comprised of resistor R5 and capacitor C9. The opposite side of parallel time constant TC3 is connected to the end winding of tertiary N3 on transformer T1 and the start winding of N3 thereof is connected to one side of parallel time constant circuit TC2 comprised of parallel resistor R4 and capacitor C8. The opposite side of parallel time constant circuit TC2 is connected to the positive DC input of bridge rectifier CR2.

The emitter of transistor Q3 is connected to the negative side of capacitor C10, the negative side of capacitor C7, the positive side of voltage regulating zener diode VR1, the negative side of parallel time constant circuit TC1, and to the negative side of bridge rectifier CR2. The positive side of capacitor C10, is connected to the emitters of Darlington transistors Q2, and the collectors of Darlington transistors Q2 are connected to one side of the photocell PC1, one side of capacitor C6, and to one side of resistor R6, and to the parallel time constant R5, C9. The base of Darlington transistor Q2 is connected to the opposite side of photocell PC1. Capacitor C10 isolates the emitter of transistor Q2 so this transistor does not receive a brute force turn-on and also assists in "soft" turn-on of transistor Q3. Photocell PC1 is connected to the positive side of capacitor C6, the positive side of diode CR3, and the collectors of Darlington transistors Q2. The negative side of capacitors C6 is also coupled to one side of resistor R3, one side (positive) of zener diode VR1, and the negative of diode bridge CR2. The positive side of zener diode VR1 is coupled to the negative side of diode CR3 and the positive terminal of capacitor C7.

The leads of photocells PC1, PC21 (FIG. 2) and resistor R29 (FIG. 2) are covered with shielding to prevent unwanted interference, and interruption of steady function.

Heater windings N4 (FIG. 2), N5, N6 of T1 contain the output leads to the fluorescent tubes. Winding N2 of transformer T1 is the secondary winding, winding N1 of transformer T1 is the primary winding, and winding N3 is the tertiary winding, all of the power E core.

Capacitor C11, between the start and end winding of N1 is a snubber capacitor which prevents spikes from entering winding N1, and capacitor C11 also stabilizes the frequency of the circuit.

Capacitor C12 (FIG. 2) and winding N2 has a similar function for secondary winding N2 of transmitter T1.

The tertiary winding N3 is connected to the outputs of capacitor C10, resistor R5, and capacitor C9, resistor R4. Capacitor C9 and C10 act as voltage regulators keeping the voltage into the tubes at a constant level.

TABLE I PARTS LIST (FIG. 1)

Figure 2:
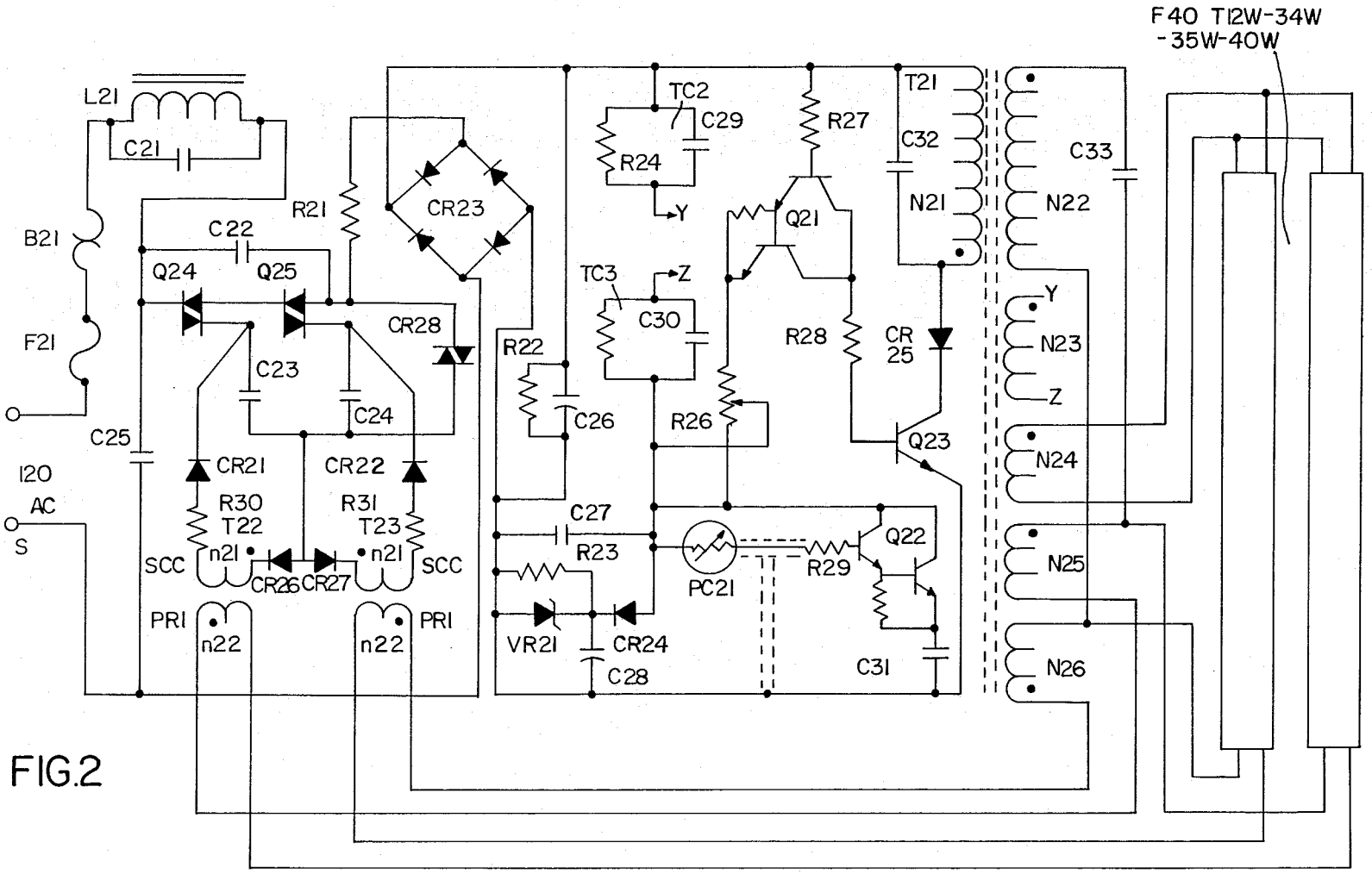
FIG. 2 is an electrical schematic diagram illustrating another embodiment of the electrical circuit of the present invention.

L1 input choke approximately 165 millihenries grain oriented silicon steel
C1,2mfd 200 v
C2,1mfd 200 v
C3,0.5mfd 50 v
C4,0.5mfd 50 v
C5,1mfd 200 v
C6,100mdf 150 v electrolytic
C7,0.03mfd 200 v
C8,1000mfd 16 v electroytic
C9,0.047mfd 200 v
C10,0.047mfd 200 v
C11,0.047mfd 200 v
C12,0.02mfd 1000 v C13,0.02mfd 1000 v
PC1 photocell
F1 fuse 3 amp
B1 Thermal switch (resetting 95 degrees celcius
CR1, CR2, CR4, CR6, CR7, 1N4002, 100 v, 1A
CR8, diac 100 v 1A or two 1N4002 100 v 1A
CR3, full wave bridge rectifier 400 v 1A
CR5, 1N4005, 600 v 1A
VR1, 1N4747 20 v 1 W
R1, 1 ohm 1 W
R2, R4, R5, 82000 ohm 0.5 W
R3, 4,700 ohm 0.5 W
R6, 500 ohm 1 W potentiometer
R7, 150,000 ohm 0.5 W
R8, 68 ohm 1 W
R9, 100,000 ohm 1 W
R10, R11, 10 ohm 0.5 W
Q1, Q2 Darlington or signal transistor
Q3, power transistor
Q4, Q5, triac
T1, ferromagnetic power E core or pot core
T2, T3, ferromagnetic torroidal cores FIG. 2 illustrates a preferred embodiment of the present invention. Protective fuse F21 protects the circuit from overloads and current surges which exceed the fuse rating. In a short circuit condition fuse F21 will open, saving the components from damage and preventing fire. A thermal protective resetting switch B21 protects the circuit from overvoltage or current surges for prolonged periods. In a sustained overload condition which is still too minimal to cause fuse F21 to open, thermal resetting switch B21 will open when its temperature maximum (approximately 90 Degrees C.) is reached; thermal resetting switch B21 recloses allowing normal circuit operation when the surge or fault is removed. Input inductive choke L21 causes a lagging voltage of approximately 90 degrees relative to the current. Choke L21 increases the power factor of the circuit insuring maximum operation and also acts as a feedback filter for electromagnetic interference since the coil has a high AC resistance.

Filter capacitor C21 causes a lagging current relative to the voltage and approximately 90 degrees out of phase with it. Coupled with the lagging voltage there is an out-of-phase operation between voltage and current of approximately 180 degrees. Capacitor C21 also increases the power factor and its value is determined by the input frequency and its reactance to closely approximate the inductive reactance of L21 creating a parallel resonant circuit.

Filter and loading capacitor C22 also eliminates noise in the circuit and acts as a start up capacitor for the circuit. Capacitor C22 aids in eliminating electromagnetic interference from the triacs (Q24, Q25) and capacitor C22 also aids in eliminating noise from the full wave rectifier CR23, while providing a cleaner AC signal to rectifier CR23. Surge protective resistor R21 protects rectifier CR23 and prevents overloads, especially on the turn-on of the circuit.

Filter capacitors C23 and C24 are connected to the gate electrodes of triac Q24 and triac Q25 respectively. Capacitors C23 and C24 provide constant DC signals to the gate electrodes of triacs Q24, Q25 which keep the triacs switched on, rather than having them switch on and off which would shorten component life and waste energy. Diodes CR21 and CR22 provide positive DC voltage to the gate electrodes of triacs Q24 and Q25, respectively, to limit the voltage to a safe level. Safety resistors R30 and R31 insure a smooth steady level of voltage to the gates of Q24 and Q25. Diodes CR26 and CR27 keep the voltage through transformer windings T22 and T23, respectively, constant and at a low level and also insure low level voltages to capacitors C23 and C24.

The secondaries (n 21) of torroidal transformer T22 and T23 take the low voltage from the tube heater windings of the primaries (n 22) to provide the signal to diodes CR21 and CR22 to turn on the gates of triacs Q24 an Q25.

Signal transformers T22 and T23 receive signals from N25 and N26 of T21, respectively, and provide the signal for the gates of Q24 and Q25. Since T22 and T23 are isolation transformers, they prevent surges from reaching the gate electrodes of triacs Q24 and Q25.

Filter capacitor C25 aids in eliminating electromagnetic interference and assists in improving the power factor of the circuit and also provides a purer AC signal for full wave bridge CR23. Filter capacitor C26 reduces the ripple voltage from CR23 and provides a purer DC voltage. Bleeder resistor R22 insures the discharge of C26 during the off cycle.

Still referring to FIG. 2, an analysis of the features is as follows: In the AC input section the components labeled L21, C21, C22, C23, C24, Q24, Q25, CR21, CR22, T22, T23 have the following functional qualities. Capacitor C21 smoothes the voltage input to choke L21 and as a parallel resonant circuit has minimal ripple current conducted to it and these components (L21 and C21) have approximately equal impedance at the ripple frequency. Capacitor C22 allows the starter voltage in the circuit to remain constant at low levels and keeps the oscillator stage at approximately 1 to 2 watts should a tube fail or be pulled from the circuit.

Capacitor C23 aids in elimination of electromagnetic interference and smooths the pulse into transistors Q24 and Q25. Choke coil L21 causes a lagging voltage and capacitor C 21 causes a lagging current approximately 180 degrees out of phase which together give an increased power factor and reduce electromagnetic interference. Capacitor C23 is also a filter capacitor and is connected to the gate of transistor Q24 and is part of the positive DC network and it provides a constant positive DC signal to the gate of transistor Q24 which keeps that transistor switched on rather than having it constantly switching on and off which would waste energy and shorten component life.

As noted above diode CR21 provides a positive signal to the gate of triac Q24 and limits the voltage so that no overload occurs. The voltage is limited to approximately 2 volts at approximately 50 milliamps. The primary of transformer T22 is in series with the heater windings of a fluorescent lamp load L. Secondary winding N21 of this transformer boosts voltage received from approximately 1.5 volts to approximately 3 volts and provides the signal to diode CR21.

Another function of triac Q24 is that its gate will open when a tube is pulled or fails in the circuit thereby putting the circuit into an idle state with a very low voltage (open circuit) and negligible current thereby vastly reducing the shock hazard present in all other circuits.

Biasing resistor R27 is on the base of Darlington transistor pair Q21. Transistor Q21 is a signal transistor which shapes the wave to the base of transistor Q23. Transistor Q23 receives a signal from resistor R26 which is mainly sawtooth and reshapes into a square wave. Transistor Q21 also controls the current into the base of transistor Q23 with resistor R28. Wave shaping is accomplished by the rapid turn on and resistance offered to the sawtooth wave.

The "Soft-on" section circuit includes capacitor C27, resistor R23, voltage regulator VR21, diode CR24, capacitors C28 and C27 and is part of the biasing network for transistor Q23, and aids in controlling the voltage and current through resistor R25, capacitor C30, and prevents transistor Q23 from ramping. Capacitor C27 is also part of the wave shaping network. Resistor R23 is a bleeder resistor for capacitor C28 to insure discharge after turn-off. Capacitor C28 is part of the delayed "soft-on" network for the base of transistor Q23 has a relatively large capacitance value. Tertiary winding N23 YZ of transformer T21 provides a turn-on signal to capacitor C29 and resistor R24, and capacitor C30 and resistor R25. Capacitor C28 causes a delay while charging. Diode CR24 passes a positive voltage and zener diode VR21 controls the amount of voltage on capacitor C28 to approximately 20 volts. Diode CR24 passes the positive voltage to the base of Darlington transistor Q22, through the photocell PC21 and resistor R29, which constitute an automatic dimming network, through Darlington transistors Q22 and Q21, resistor R27 which shapes the wave and prevents unwanted noise from reaching transistor Q23. This network prevents hard turn-on of transistor Q23 and provides a soft turn on thus prolonging component life and tube life, and suppress radio frequency interference (RFI).

Capacitor C29 and resistor R24, and capacitor C30 and resistor R25, reduce the signal from tertiary winding N23, and capacitor C30 and resistor R25 provide a positive signal to diode CR24, while capacitor C30 and resistor R25, capacitor C29 and resistor R24 also act as a regulator for winding N23. The two parallel RC time constants also aid in rounding the sawtooth waves.

In the automatic dimming section, as light strikes photocell PC21, the resistance increases causing the base of transistor Q22 to open and allows the current to pass through capacitor C31, thus causing a drop in current on transistor Q23 which causes the unit to dim automatically since transistor Q23 is not being driven with a normally high voltage. Resistor R21 in conjunction with the photocell PC21 provides biasing for transistor Q22. Photocell PC21 may be utilized independently of manual dimmer potentiometer or in conjunction with it for great energy savings.

Still referring to FIG. 2, resistors R30 and R31 limit voltage and current to diodes CR21 and CR22 and to the gates of the triacs Q24 and Q25. Voltage from the primary of torroidal transformers T22, T23, is increased at the secondaries thereof, especially during a dead tube or pulled tube condition or when power is turned on and off rapidly. Resistors R30 and R31 aid in preventing the triacs Q24 and Q25 from overloading on their gates.

Diac CR28 limits current to the gates of the triacs Q24 and Q25 during a pulled tube or dead tube condition. Diac CR28 prevents the triacs from being overloaded with voltage. Diac CR28 also aids in suppressing spikes, electromagnetic radiation and radio frequency interference.

The leads of photocell PC21 and resistor R29 are covered with shielding to prevent unwanted interference and interruption of steady function.

Secondary winding N22 of transformer T21, primary winding N21 and tertiary N23 are all on the power E core of transformer T21.

Capacitor C32 is connected between the start and end winding of winding N21 and is a snubber capacitor which prevents pikes from entering the winding and capacitor C32 also stabilizes the frequency of the circuit.

Capacitor C33 performs a similar function for the secondary winding N22 of transformer T21.

The tertiary winding N23 is connected to the outputs of RC capacitor C30, resistor R25, RC capacitor C29, resistor R24 and capacitor C29 and C30 act as voltage regulators for keeping the voltage to the tubes at a constant level.

Referring to FIG. 2, the high frequency signal generated by the circuit is produced at a voltage level sufficient to excite the gases inside the fluorescent tubes to ionization. This leads to the release of ultraviolet and visible radiation. Taking a standard fluorescent tube as an example, both argon and mercury are present in the tube. The argon molecules are brought to their ionization potential by the high frequency voltage signal and begin to ionize. The movement of the argon ions coupled with the high frequency oscillations of the field then causes ionization of the more predominant mercury atoms. The mercury ions in turn give off the desired radiation as the electrons in their outer shells move from one energy level to another. A chain reaction of collissions among the mercury atoms, as the high frequency signals continue at a reduced voltage and current, has the effect of maintaining the overall ionization state.

The higher the frequency of the electrical field oscillations, the more excited the mercury atoms become, the more collisions there are among the atoms in the tube an the greater the degree of the emitted radiation. Another feature of the present invention results from high frequency signals being used for ionization making the tube filaments as presently known unnecessary. Instead, solid electrically conductive discs which last longer and emit more atoms may be used. Another unique feature of the present invention is that at the frequency range mentioned (60 Hz to 50 MHz), that the current through the lamps may be decreased to the point that very low levels of power may be used to maintain ignition of the lamps thereby saving energy and increasing lamp life.

The high frequency signal which is impressed into the tube at a sufficient voltage causes ionization of the argon at its fundamental ionization potential, and since argon has a higher ionization potential than mercury the ionized argon atoms will cause ionization of the mercury atoms.

The embodiments of the present invention can be utilized for tubes from 4 watts to 96 watts, and the circuits can be used for 1 or more tubes in series, parallel, or series parallel.

The high frequency energy saving ballast may replace the standard ballast on a one for one basis, or the high frequency energy saving ballast may be made to replace more than one standard ballast. The high frequency energy saving ballast may also be made as a central unit to handle banks of lights, or a series of them may be employed at a central location to ignite banks of lights.

The particular components of the present invention have the ability to be used over a wide range of frequencies with negligible losses.

The circuitry of the present invention will operate at a high power factor, a minimum of 0.91 and a maximum of 1.00.

The construction of the transformers of the present invention were carefully engineered to include particular materials which will be evident to those skilled in the art, for maximum performance. This includes L1 input choke, the ferromagnetic power E core of T1, and the ferromagnetic torroidal cores of T2, T3. Of course, the transformers are interchangable with other shapes having the same electrical characteristics and designed properly.

The gapping techniques used in the transformers to prevent saturation (L21, and T21), are also engineered to specific tolerances.

Skin effect and eddy current losses are negligible in the present invention, and electromagnetic interference as well as radio frequency interference are also negligible.

The dimming concept of the present invention is linear and the energy saving is proportional to the amount of dimming employed either manually with resistor R26, automatically with photocell PC21, or by utilizing both.

The present invention generates negligible heat thereby keeping losses at a minimum, prolonging component life, and increasing energy savings in an installation by reducing the air conditioning requirement.

Referring to FIG. 2, resistor R30, diode CR26, resistor R31 and diode CR27 on the secondaries of transformer T22 and T23 secondaries prevent surges from reaching the gates of triacs Q24, Q25, thereby increasing circuit reliability. These triacs are fail safe devices which have gates that will immediately open should a tube break, die, or be pulled from the circuit and reduce the open circuit voltage to a negligible level thereby removing shock and fire hazard when a tube foils or is removed from the circuit.

The R/C time constants of resistor R22 and capacitor C26, resistor R24 and capacitor C29, resistor R25 and capacitor C30 also aid in filtering out unwanted noise and they attenuate the upper and lower frequencies not desirable for proper circuit operation.

The AC input stage consisting of the AC input is unique in that it contains filtering through the choke L21 and capacitor C21 sections. This section also increases the power factor increasing the circuit efficiency. A filtering of electromagnetic and radio frequency interference is also accomplished through capacitors C22, C23, C24. Diac CR28 keeps the voltage from secondary N21 of transformer T22 and T23 at a low level preventing the gates of triacs Q24 and Q25 from overloading.

The DC and oscillator section comprises diodes CR23, CR25, RC resistor R22, and capacitor C26, RC resistor R24 and capacitor C29, RC resistor R25 and capacitor C30, manual potentiometer dimmer resistor R26 "soft-on" section capacitor C27 and resistor R23, zener voltage regulator VR21, diode CR24, capacitor C28, automatic dimming section photocell PC 21, capacitor resistor R29 and resistor transistor Q22, and capacitor C31, wave shaping section resistor R27 and transistor Q21; biasing resistor R28, power transistor Q23, capacitor C32, and primary winding N21 of output power transformer T21, secondary winding N22, snubber capacitor C33, heater windings N24, N25 and N26. The "soft-on" section is unique in that capacitor C28 causes a delay because of the loading time thereby eliminating high voltages from being applied to the base of transistor Q23, and eliminating a hard turn-on of transistor Q23. Diode CR24 and regulator VR21 function in keeping the operating voltages at a low level to insure the proper operation of capacitor C28.

The automatic dimming section is unique in that the dual function of transistor Q22, both as a signal transistor and as a wave shaping section, permits transistor Q23 to operate at lower voltages and saves significant amounts of energy over other systems. Resistor R29 prevents overloads from reaching the base of transistor Q22, and insures stable operation of photocell PC21.

The resistor R27 and transistor Q21 wave shaping section prevents waves such as sawtooth waves from reaching the base of transistor Q23 is functioning with an essentially pure square wave which optimizes its function and allows more energy to be saved, component life to be prolonged and eliminates noise generation. The preferred embodiments illustrated save significant amounts of energy in the range of 35% to 85% and are relatively reasonable to produce, as well as being commercially viable.

As various changes may be made in the form, construction and arrangement of the invention and without departing from the spirit and scope of the invention, and without sacrificing any of its advantages, it is to be understood that all matter herein is to be interpreted as illustrative and not a limiting sense.

What is claimed is:

1. In a luminescent gas discharge device power supply system having an oscillator for converting alternating current from an alternating current source to direct current for operating a luminescent gas discharge device, said oscillator comprising a transformer having a primary winding and a secondary winding, a transistor connected to said primary winding for generating a predetermined high frequency signal in said primary winding, an oscillatory circuit including said transitor and said primary winding and a feedback circuit, and means connecting said secondary winding to said luminescent gas discharge device, the improvement comprising:

a biasing circuit connected to said transistor for preventing said transistor from ramping thereby preventing hard turn-on of said transistor to prolong component and discharge device life, said biasing circuit including rectifier means for converting said alternating current to said direct current and a capacitor connected to the emitter side of said transistor for providing a delayed charge to smoothly deliver initial turn-on current to said luminescent gas discharge device;

said feedback circuit including a tertiary winding of said transformer, said tertiary winding including a start winding and an end winding, said start winding of said tertiary winding being connected to the base of said transistor through a parallel time constant circuit and a biasing resistor;

waveshaping means for supplying shaped wave current to said transformer and including a Darlington connected transistor pair connected to the base of said transistor to control current thereto;

said luminescent gas discharge device including heated filaments and said transformer including filament winding means for providing current to said filaments; and a sensing circuit comprising, sensing means connected in circuit with said filaments for sensing failure and/or removal of said luminescent gas discharge device from said system, means for producing a signal in response to said failure and/or removal of said luminescent gas discharge device from said system, and switch means connected between said alternating current source and said rectifier means for responding to said control signal to halt flow of said alternating current to said rectifier and thus from said oscillator.

2. The power supply system defined in claim 1, wherein said biasing circuit including means for dimming the light from said luminescent gas discharge devices.

3. The power supply system defined in claim 2 wherein said means for dimming includes a photoelectric device.

4. The power supply system defined in claim 2 wherein said means for dimming includes a manually operated potentiometer.

5. The power supply system defined in claim 1 including isolating transformer means connected between said filament winding and said switch means and constituting said sensing means.

6. The power supply system defined in claim 1 including means for linear dimming of light from said luminescent gas discharge device and saving energy.

7. The luminescent gas discharge power supply system defined in claim 1, wherein said switch means is a solid state switch, and said sensing means includes a winding on said transformer for generating a signal indicating the said failure and/or removal of said luminescent gas discharge device.

8. The luminescent gas discharge device power supply system as defined in claim 1, further comprising a plurality of said discharge devices, and a sensing circuit for each device, each said sensing circuit, respectively, being connected to said power supply system so as to remove power from said oscillator upon sensing the said failure and/or removal of a luminescent gas discharge device.

* * * * *